US006818592B2

(12) United States Patent
Watanabe et al.

(10) Patent No.: US 6,818,592 B2
(45) Date of Patent: Nov. 16, 2004

(54) HEAT-SENSITIVE RECORDING MATERIAL

(75) Inventors: Tsutomu Watanabe, Shizuoka-ken (JP); Masayuki Iwasaki, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 118 days.

(21) Appl. No.: 10/224,595

(22) Filed: Aug. 21, 2002

(65) Prior Publication Data

US 2003/0114307 A1 Jun. 19, 2003

(30) Foreign Application Priority Data

Aug. 24, 2001 (JP) ..... 2001-254711

(51) Int. Cl.[7] ..... B41M 5/20

(52) U.S. Cl. ..... 503/208; 503/209; 503/216

(58) Field of Search ..... 503/209, 208, 503/216

(56) References Cited

U.S. PATENT DOCUMENTS 6,642,175 B2 * 11/2003 Mitsuo et al. ..... 503/209
6,699,816 B2 * 3/2004 Iwasaki et al. ..... 503/209

* cited by examiner

*Primary Examiner*—N. Edwards
(74) *Attorney, Agent, or Firm*—Sughrue Mion, PLLC

(57) ABSTRACT

A heat-sensitive recording material includes a support having disposed thereon a heat-sensitive color-forming layer that includes an electron-donating leuco-dye, an electron-receiving compound and an UV absorbent, wherein the layer contains 4-hydroxybenzenesulfonanilide as the electron-receiving compound. Because the layer includes 4-hydroxybenzenesulfonanilide, the heat-sensitive recording material has high sensitivity and improved image preservability, chemical resistance and sticking resistance.

20 Claims, No Drawings

HEAT-SENSITIVE RECORDING MATERIAL

BACKGROUND OF THE INVENTION

1. Field of the Invention

The present invention relates to a heat-sensitive recording material, and in particular to, a heat-sensitive recording material that has high sensitivity and excellent background fogging resistance, image preservability, background lightfastness, chemical resistance and inkjet printability.

2. Description of the Related Art

Heat-sensitive recording materials are widely used because they are relatively inexpensive and capable of being processed in compact, maintenance-free recording apparatus. Sales of heat-sensitive recording paper have in recent times become highly competitive, and there is a demand to further increase the functions of heat-sensitive recording materials as discriminated from conventional functions. Thus, extensive research is being conducted with respect to color density and image preservability of heat-sensitive recording materials.

Conventionally, 2,2-bis(4-hydroxyphenyl)propane ("bisphenol A") has been widely used as the electron-receiving compound with respect to the electron-donating leuco-dye used in such heat-sensitive recording materials. However, heat-sensitive recording materials that are satisfactory in terms of sensitivity, background fogging resistance, image preservability, chemical resistance and sticking resistance have not yet been obtained.

SUMMARY OF THE INVENTION

It is an object of the present invention to provide a heat-sensitive recording material that has high sensitivity and excellent background fogging resistance, image preservability, background lightfastness, chemical resistance and inkjet printability.

The present inventors conducted exhaustive investigations into electron-donating leuco-dyes, electron-receiving compounds and UV absorbents to develop such a heat-sensitive recording material, and thus completed the present invention.

Specifically, the invention is a heat-sensitive recording material comprising a support having disposed thereon a heat-sensitive color-forming layer that includes an electron-donating leuco-dye, an electron-receiving compound and an UV absorbent, wherein the layer contains 4-hydroxybenzenesulfonanilide as the electron-receiving compound.

DESCRIPTION OF THE PREFERRED EMBODIMENT

A heat-sensitive recording material of the present invention comprises a support having disposed thereon a heat-sensitive color-forming layer that includes an electron-donating leuco-dye, an electron-receiving compound and an UV absorbent, wherein the layer contains 4-hydroxybenzenesulfonanilide as the electron-receiving compound. The heat-sensitive recording material of the invention is described in detail below.

Support

Conventionally known supports may be used for the support of the invention. Specific examples include supports made of paper such as woodfree paper, paper coated with a resin or a pigment, resin-laminated paper, undercoated base paper disposed with an undercoat layer, synthetic paper, and plastic film supports. Undercoated base paper disposed with an undercoat layer is preferable in view of heat-sensitive head compatibility. Undercoated base paper disposed, using a blade coater, with an undercoat layer including an oil-absorbing pigment is particularly preferable.

A support having a degree of surface smoothness stipulated by JIS-P8119 of at least 300 seconds is preferable in view of dot reproducibility.

As mentioned above, the support of the invention preferably includes an undercoat layer. The undercoat layer is preferably disposed on a base support having a Steckigt sizing degree (Stöckigt sizing degree) of at least 5 seconds, and preferably consists essentially of pigment and binder.

Although all ordinary inorganic or organic pigments may be used for the pigment, the pigment is preferably an oil-absorbing dye that has a degree of oil absorption stipulated by JIS-K5101 of at least 40 ml/100 g (cc/100 g). Specific examples thereof include calcined kaolin, aluminium oxide, magnesium carbonate, calcium carbonate, amorphous silica, calcined diatomaceous earth, aluminium silicate, magnesium aluminosilicate and aluminium hydroxide. Calcined kaolin having a degree of oil absorption stipulated by JIS-K5101 of at least 70 ml/100 g is particularly preferable.

Examples of the binder used in the undercoat layer include water-soluble polymers and soluble binders. These can be used singly or two or more can be used in combination.

Examples of water-soluble polymers include starch, polyvinyl alcohol, polyacrylamide, carboxymethyl alcohol, methyl cellulose, and casein.

The soluble binder is generally synthetic rubber latex or synthetic resin emulsion. Examples thereof include styrene-butadiene rubber latex (SBR), acrylonitrile-butadiene rubber latex, methyl acrylate-butadiene rubber latex, and polyvinyl acetate emulsion.

The amount of the binder used is determined depending on the film strength of the coated layer and on the heat-sensitive sensitivity of the heat-sensitive color-forming layer. In general, it is 3 to 100% by mass, preferably 5 to 50% by mass, and more preferably 8 to 15% by mass, based on the pigment added to the undercoat layer. The undercoat layer may also include wax, discoloration inhibitors, surfactants and the like.

The undercoat layer can be coated using any known coating method. Specific examples thereof include methods using an air-knife coater, a roll coater, a blade coater, a gravure coater, or a curtain coater. It is preferable to use a blade coater to coat the undercoat layer. The undercoated support may also be subjected as needed to smoothing, such as calendering.

The blade coater is not limited to a bevel blade coater or a vented blade coater, and may include a rod blade coater, a bill blade coater and the like. The blade coater is also not limited to an off-machine coater. An on-machine coater disposed in a paper machine may also be used. In order to enhance flowability when the coating liquid for the undercoat layer is blade-coated and to obtain surface smoothness and a surface form, carboxymethyl cellulose having a degree of etherification of 0.6 to 0.8 and a weight-average molecular weight of 20,000 to 200,000 may be added to the coating liquid at 1 to 5% by mass, and preferably 1 to 3% by mass, with respect to the pigment.

Although there are no particular limitations on the coating amount of the undercoat layer, the weight after drying is at least 2 g/m$^2$, preferably at least 4 g/m$^2$, and more preferably 7 g/m$^2$ to 12 g/m$^2$, in accordance with the properties of the heat-sensitive recording material.

Heat-sensitive Color-Forming Layer

The heat-sensitive color-forming layer formed on the support is characterized in that it includes at least an electron-donating leuco-dye, an electron-receiving compound and an UV absorbent.

Electron-Donating Leuco-Dye

The electron-donating leuco-dye is preferably at least one selected from 2-anilino-3-methyl-6-di-n-butylaminofluoran, 2-anilino-3-methyl-6-di-n-amylaminofluoran, 2-anilino-3-methyl-6-(N-ethyl-N-p-benzyl)aminofluoran, 2-anilino-3-methyl-6-diethylaminofluoran, 2-anilino-3-methyl-6-(N-ethyl-N-isoamylamino)fluoran, and 2-anilino-3-methyl-6-(N-ethyl-N-propylamino)fluoran. These may be used singly or in a combination of two or more.

By using as the electron-donating leuco-dye at least one selected from 2-anilino-3-methyl-6-di-n-butylaminofluoran, 2-anilino-3-methyl-6-di-n-amylaminofluoran, 2-anilino-3-methyl-6-(N-ethyl-N-p-benzyl)aminofluoran, 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran, color density and preservability of image portions can be further improved. In particular, 2-anilino-3-methyl-6-di-n-butylaminofluoran, 2-anilino-3-methyl-6-di-n-amylaminofluoran and 2-anilino-3-methyl-6-(N-ethyl-N-p-benzyl)aminofluoran are preferable in view of sensitivity, image preservability and background lightfastness.

Other known electron-donating leuco-dyes can be used together with the above-mentioned electron-donating leuco-dyes as long as the effects of the invention are not compromised.

Examples of known electron-donating leuco-dyes include 2-anilino-3-methyl-6-(N-ethyl-N-sec-butyl)aminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-di(n-butylamino)-7-(2-chloroanilino)fluoran, 3-diethylamino-7-(2-chloroanilino)fluoran, 3-diethylamino-6-methyl-7-anilinofluoran, and 3-(N-cyclohexyl-N-methylamino)-6-methyl-7-anilinofluoran.

When known electron-donating leuco-dyes are used together with the above-mentioned electron-donating leuco-dyes, the content of the electron-donating leuco-dye selected from 2-anilino-3-methyl-6-di-n-butylaminofluoran, 2-anilino-3-methyl-6-di-n-amylaminofluoran, 2-anilino-3-methyl-6-(N-ethyl-N-p-benzyl)aminofluoran, 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran is preferably at least 50% by mass, more preferably at least 70% by mass and most preferably at least 90% by mass, of the entire content of the electron-donating leuco-dyes included in the layer.

The coating amount of the electron-donating leuco-dye is preferably 0.1 to 1.0 g/m$^2$, and more preferably 0.2 to 0.5 g/m$^2$, in view of color density and background fogging density.

Electron-Receiving Compound

The heat-sensitive recording material of the invention is characterized in that it contains 4-hydroxybenzenesulfonanilide as the electron-receiving compound. Because the heat-sensitive recording material of the invention contains 4-hydroxybenzenesulfonanilide as the electron-receiving compound, sensitivity can be raised and image preservability, chemical resistance and sticking resistance can be improved.

The amount of the electron-receiving compound added is preferably 50 to 400% by mass, more preferably 100 to 300% by mass, and most preferably 150 to 250% by mass, with respect to the electron-donating leuco-dye.

Other known electron-receiving compounds can also be used with 4-hydroxybenzenesulfonanilide as the electron-receiving compound of the invention as long as the effects of the invention are not compromised.

Although the other known electron-receiving compounds may be suitably selected and used, phenolic compounds or salicylic acid derivatives and their polyvalent metal salts are preferable in view of preventing background fogging.

Examples of the phenolic compounds include 2,2'-bis(4-hydroxyphenol)propane (bisphenol A), 4-t-butylphenol, 4-phenylphenol, 4-hydroxy-diphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylidendiphenol, 4-tert-octylphenol, 4-p-methylphenylphenol, 4,4'-methylcyclohexylidenephenol, 4,4'-isopentylidenephenol, 4-hydroxy-4-isopropyloxydiphenylsulfone, 4,4'-dihydroxydiphenylsulfone, 2,4'-dihydroxydiphenylsulfone, 2,4-bis(phenylsulfonyl)phenol, N-(4-hydroxyphenyl)-p-toluenesulfonamide, and benzyl p-hydroxy benzyl benzoate.

Examples of the salicylic acid derivatives and their polyvalent metal salts include_4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and their salts with zinc, aluminium, calcium, copper, lead and the like.

When known electron-receiving compounds are used together with 4-hydroxyenzenesulfonanilide in the invention, the amount of 4-hydroxyenzenesulfonanilide is preferably at least 50% by mass, more preferably at least 70% by mass, and most preferably at least 80% by mass, with respect to the total amount of the electron-receiving compounds.

When the coating liquid for the heat-sensitive color-forming layer is prepared, the volume-average particle diameter of the electron-receiving compound is at most 1.0 μm, more preferably 0.2 to 0.8 μm, and even more preferably 0.4 to 0.7 μm. When the volume-average particle diameter exceeds 1.0 μm, the heat-sensitive sensitivity of the recording material is lowered. The volume-average particle size may be easily measured with a laser-diffraction particle size analyzer (e.g., "LA500" available from Horiba Corporation).

UV Absorbent

The heat-sensitive recording material of the invention is characterized in that it contains a UV absorbent in its heat-sensitive color-forming layer. The UV absorbent is preferably a benzotriazole UV absorbent. Particularly preferable examples of the UV absorbent include those indicated below.

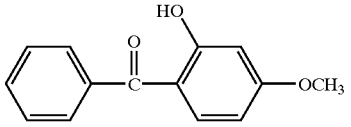

-continued

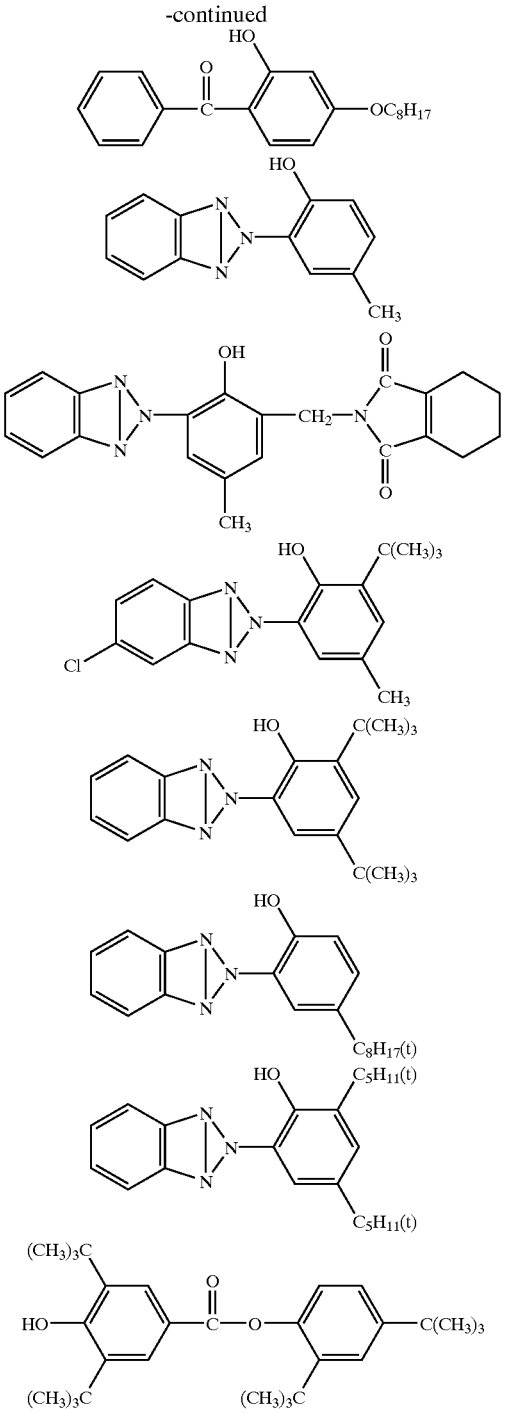

The heat-sensitive color-forming layer preferably contains 10 to 100 parts by mass, and more preferably from 20 to 80 parts by mass, of the benzotriazole type UV absorbent with respect to 100 parts by mass of the electron-receiving compound comprised in the layer, in view of achieving balanced sensitivity and image preservability.

Image Stabilizer

The heat-sensitive color-forming layer of the invention preferably contains an image stabilizer. As the image stabilizer, phenolic compounds, especially hindered phenol compounds, are effective. Examples thereof include 1,1,3-tris(2-methyl-4-hydroxy-5-tert-butylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

The total amount of the image stabilizer is preferably 10 and 100 parts by mass, more preferably 15 to 80 parts by mass, and even more preferably 20 to 60 parts by mass, with respect to 100 parts by mass of the electron-donating leuco-dye, in order for the effects of preventing background fogging and improving image preservability to be exhibited.

Sensitizer

The heat-sensitive color-forming layer of the invention preferably contains a sensitizer. Preferred examples of the sensitizer include aliphatic monoamides, stearylurea, p-benzylbiphenyl, di(2-methylphenoxy)ethane, di(2-methoxyphenoxy)ethane, β-naphthol-(p-methylbenzyl) ether, α-naphthyl benzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediol phenyl ether, diethylene glycol bis(4-methoxyphenyl)ether, m-terphenyl, methyl oxalate benzyl ether, 1,2-diphenoxymethylbenzene, 1,2-bis(3-methylphenoxy)ethane, and 1,4-bis(phenoxymethyl) benzene.

The total amount of the sensitizer is preferably 75 to 200 parts by mass, more preferably 90 to 180 parts by mass, and even more preferably 100 to 150 parts by mass, relative to 100 parts by mass of the 4-hydroxybenzenesulfonanilide that is the electron-receiving compound. When the sensitizer is 75 to 200 parts by mass, sensitivity is high and image preservability is good.

The electron-donating leuco-dye, the electron-receiving compound and the sensitizer may be dispersed in a water-soluble binder. The water-soluble binder used in this case is preferably a compound having a solubility in water at 25° C. of at least 5% by mass.

Examples of the water-soluble binder include polyvinyl alcohol, methyl cellulose, carboxymethyl cellulose, starches (including modified starches), gelatin, gum arabic, casein, and saponified material of styrene-maleic anhydride copolymer The binder is used not only for dispersion but also to improve the coated film strength of the heat-sensitive color-forming layer. To this end, the water-soluble binder may be combined with a synthetic polymer latex type binder such as styrene-butadiene copolymer, vinyl acetate copolymer, acrylonitrile-butadiene copolymer, methyl acrylate-butadiene copolymer or polyvinylidene chloride.

The electron-donating leuco-dye, electron-receiving compound and sensitizer may be dispersed at the same time or separately with a stirring pulverizer such as a ball mill, an attritor, or a sand mill, to thereby prepare the coating liquid. The coating liquid may contain as needed a pigment, a metal soap, a wax, a surfactant, an antistatic agent, an UV absorbent, a defoaming agent, and a fluorescent dye.

Examples of the pigment include calcium carbonate, barium sulfate, lithopone, agalmatolite, kaolin, calcined kaolin, amorphous silica and aluminium hydroxide. The metal soap may be a metal salt of a higher fatty acid, and examples thereof include zinc stearate, calcium stearate and aluminium stearate.

Examples of the wax include paraffin wax, microcrystalline wax, carnauba wax, methylolstearamide, polyethylene wax, polystyrene wax and fatty acid amide-type wax. These waxes may be used either singly or combined. Examples of the surfactant include alkali metal salts of sulfosuccinic acids, and fluorine-containing surfactants.

These materials are coated onto the support after being mixed. There are no particular limitations on how the materials are coated. For example, the materials may be coated with an air-knife coater, a roll coater, a blade coater, a curtain coater or the like, and then dried and leveled (smoothed) with a calender. A curtain coater is preferably used in the invention. Additionally, although there are no particular limitations on the coating amount of the heat-sensitive color-forming layer, ordinarily it is preferable for the dry mass thereof to be 2 to 7 $g/m^2$, and more preferably 3 to 6 $g/m^2$.

The heat-sensitive recording material of the invention preferably has an image preservability of at least 65%. Image preservability is indicated by the ratio of image density measured with a Macbeth reflection densitometer (e.g., RD-918) just after printing to image density after printing under the same condition as above and left for 24 hours in an environment of 60° C. and 20% relative humidity.

Image Preservability (%)=[(image density after being left under conditions described above)/(image density just after printing)]×100.

A protective layer may be formed as needed on the heat-sensitive color-forming layer. The protective layer may contain an organic or inorganic fine powder, a binder, a surfactant, and heat-fusible substances. Examples of the fine inorganic powder includes calcium carbonate, amorphous silica, zinc oxide, titanium oxide, aluminium hydroxide, zinc hydroxide, barium sulfate, clay, talc, surface-processed calcium and silica. Examples of the fine organic powder include urea-formalin resin, styrene-methacrylic acid copolymer, and polystyrene.

Examples of the binder in the protective layer include polyvinyl alcohol, carboxy-modified polyvinyl alcohol, vinyl acetate-acrylamide copolymer, silicon-modified polyvinyl alcohol, starch, modified starch, methyl cellulose, carboxymethyl cellulose, hydroxymethyl cellulose, gelatins, gum arabic, casein, hydrolyzed styrene-maleic acid copolymer, polyacrylamide derivatives, polyvinyl pyrolidone, and latexes such as styrene-butadiene rubber latex, acrylonitrile-butadiene rubber latex, methyl acrylate-butadiene rubber latex, and polyvinyl acetate emulsion.

A waterproofing agent that crosslinks the binder component in the protective layer can be added to further improve storage stability of the heat-sensitive recording material. Examples of the waterproofing agent include water-soluble precondensates such as N-methylolurea, N-methylolmelamine, urea-formalin; dialdehyde compounds such as glyoxal, glutaraldehyde; inorganic crosslinking agents such as boric acid, borax, colloidal silica; and polyamide-epichlorohydrin.

EXAMPLES

The present invention will now be described with reference to the following examples. However, these examples are not intended to restrict the scope of the invention. Unless otherwise indicated, "parts" and "%" in the following Examples are all by mass.

Example 1

Fabrication of Heat-sensitive Recording Material

Preparation of Coating Liquid for Heat-sensitive Color-Forming Layer (Preparation of Dispersion A)

The following ingredients were dispersed with a ball mill and mixed to prepare a dispersion A having a mean particle size of 0.7 μm.

| Composition of Dispersion A | |
|---|---|
| 2-anilino-3-methyl-6-di-n-butylaminofluoran (electron-donating leuco-dye) | 10 parts |
| 2.5% aqueous solution of polyvinyl alcohol (PVA-105 obtainable from Kuraray Co., Ltd.) | 50 parts |

(Preparation of Dispersion B)

The following ingredients were dispersed with a ball mill and mixed to prepare a dispersion B having a mean particle size of 0.7 μm.

| Composition of Dispersion B | |
|---|---|
| 4-hydroxybenzenesulfonanilide (electron-receiving compound) | 20 parts |
| 2.5% aqueous solution of polyvinyl alcohol (PVA-105 obtainable from Kuraray Co., Ltd.) | 100 parts |

(Preparation of Dispersion C)

The following ingredients were dispersed with a ball mill and mixed to prepare a dispersion C having a mean particle size of 0.7 μm.

| Composition of Dispersion C | |
|---|---|
| 2-benzyloxynaphthalene (sensitizer) | 20 parts |
| 2.5% aqueous solution of polyvinyl alcohol (PVA-105 obtainable from Kuraray Co., Ltd.) | 100 parts |

(Preparation of Dispersion D)

The following ingredients were dispersed with a ball mill and mixed to prepare a dispersion D having a mean particle size of 0.7 μm.

| Composition of Dispersion D | |
|---|---|
| 2-(2-hydroxy-5-methylphenyl)benzotriazole (UV absorbent) | 5 parts |
| 2.5% aqueous solution of polyvinyl alcohol (PVA-105 obtainable from Kuraray Co., Ltd.) | 25 parts |

(Preparation of Pigment Dispersion E)

The following ingredients were dispersed with a sand mill and mixed to prepare a pigment dispersion E having a mean particle size of 2.0 μm.

| Composition of Pigment Dispersion E | |
|---|---|
| Light calcium carbonate | 40 parts |
| Sodium polyacrylate | 1 part |
| Water | 60 parts |

The following compounds were mixed to prepare a coating liquid for a heat-sensitive color-forming layer.

| Composition of Coating Liquid for Heat-sensitive Color-Forming Layer | |
|---|---|
| Dispersion A | 60 parts |
| Dispersion B | 120 parts |
| Dispersion C | 120 parts |
| Dispersion D | 30 parts |
| Pigment dispersion E | 101 parts |
| Emulsion of stearamide (20%, sensitizer) | 50 parts |
| 30% Dispersion of zinc stearate | 15 parts |
| Paraffin wax (30%) | 15 parts |
| Sodium dodecylbenzenesulfonate (25%) | 4 parts |

Fabrication of Heat-sensitive Recording Material

A coating liquid for an undercoat layer was coated with a blade coater onto woodfree paper (having a basic weight of 50 g/m$^2$) so that the coated amount after drying was 8 g/m$^2$. The layer was calendered after drying to thereby prepare a base paper coated with an undercoat layer. Next, the coating liquid for the heat-sensitive recording material was coated with a curtain coater onto the undercoat layer of the base paper to form thereon a heat-sensitive color-forming layer having a dry weight of 4.5 g/m$^2$. The surface of the heat-sensitive color-forming layer was calendered after drying to obtain a heat-sensitive recording material of Example 1.

Example 2

A heat-sensitive recording material of Example 2 was fabricated in the same manner as in Example 1, except that the dispersion A contained 2-anilino-3-methyl-6-di-n-amylaminofluoran in place of 2-anilino-3-methyl-6-di-n-butylaminofluoran.

Example 3

A heat-sensitive recording material of Example 3 was fabricated in the same manner as in Example 1, except that the dispersion A contained 2-anilino-3-methyl-6-(N-ethyl-N-p-benzyl)aminofluoran in place of 2-anilino-3-methyl-6-di-n-butylaminofluoran.

Example 4

A heat-sensitive recording material of Example 4 was fabricated in the same manner as in Example 1, except that the dispersion A contained 2-anilino-3-methyl-6-diethylaminofluoran in place of 2-anilino-3-methyl-6-di-n-butylaminofluoran.

Example 5

A heat-sensitive recording material of Example 5 was fabricated in the same manner as in Example 1, except that the dispersion A contained 2-anilino-3-methyl-6-(N-ethyl-N-isoamylamino)fluoran in place of 2-anilino-3-methyl-6-di-n-butylaminofluoran.

Example 6

A heat-sensitive recording material of Example 6 was fabricated in the same manner as in Example 1, except that the dispersion A contained 2-anilino-3-methyl-6-(N-ethyl-N-propylamino)fluoran in place of 2-anilino-3-methyl-6-di-n-butylaminofluoran.

Example 7

A heat-sensitive recording material of Example 7 was fabricated in the same manner as in Example 1, except that the dispersion D contained 2-(2-hydroxy-3,5-di-tert-butylphenyl)benzotriazole in place of 2-(2-hydroxy-5-methylphenyl)benzotriazole.

Example 8

A heat-sensitive recording material of Example 8 was fabricated in the same manner as in Example 1, except that the dispersion D contained 2 parts, and not 5 parts, of 2-(2-hydroxy-5-methylphenyl)benzotriazole, and 27 parts, and not 30 parts, of the dispersion D was used.

Example 9

A heat-sensitive recording material of Example 9 was fabricated in the same manner as in Example 1, except that the dispersion D contained 10 parts, and not 5 parts, of 2-(2-hydroxy-5-methylphenyl)benzotriazole, and 35 parts, and not 30 parts, of the dispersion D was used.

Example 10

A heat-sensitive recording material of Example 10 was fabricated in the same manner as in Example 1, except that the dispersion D contained 20 parts, and not 5 parts, of 2-(2-hydroxy-5-methylphenyl)benzotriazole, and 45 parts, and not 30 parts, of the dispersion D was used.

Comparative

Example 1

A heat-sensitive recording material of Comparative Example 1 was fabricated in the same manner as in Example 1, except that the dispersion B contained 2,2-bis(4-hydroxyphenyl)propane [bisphenol A] in place of 4-hydroxybenzenesulfonanilide.

Comparative Example 2

A heat-sensitive recording material of Comparative Example 2 was fabricated in the same manner as in Example 1, except that the dispersion B contained N-benzyl-4-hydroxybenzenesulfonamide in place of 4-hydroxybenzenesulfonanilide.

Comparative Example 3

A heat-sensitive recording material of Comparative Example 3 was fabricated in the same manner as in Example 1, except that the dispersion D did not contain 2-(2-hydroxy-5-methylphenyl)benzotriazole.

Evaluation (1) Sensitivity

Using a heat-sensitive printer equipped with a heat-sensitive head (KJT-216-8MPD1 available from Kyocera Corpo.) and a pressure roll disposed just before the heat-sensitive head and loaded at 100 kg/cm$^2$, the heat-sensitive recording materials of Examples 1 to 10 and Comparative Examples 1 to 3 were printed. The head voltage was 24 V; the pulse repetition period was 10 ms; and the pulse width was 1.5 ms. The print density of each sample was measured with a Macbeth reflection densitometer, RD-918. The data are given in Table 1.

(2) Background Fogging

The heat-sensitive recording materials of Examples 1 to 10 and Comparative Examples 1 to 3 were left for 24 hours in an environment of 60° C. and 20% relative humidity. After having been thus left, background fogging was measured with a Macbeth reflection densitometer, RD-918. The data are given in Table 1. The lower the value is, the better the results-were.

(3) Image Preservability

Using the same device under the same conditions as in the above (1), an image was recorded on the heat-sensitive recording materials of Examples 1 to 10 and Comparative Examples 1 to 3, and then the materials were left for 24 hours in an environment of 60° C. and 20% relative humidity. Thereafter, image density was measured with a Macbeth reflection densitometer, RD-918, and survival rate with respect to image density of an unprocessed material having an image recorded thereon using the same device as in (1) and under the same conditions was calculated using the following equation. The results are given in Table 1. The higher the value is, the better was image preservability.

Image Preservability (%)=(image density after being left/unprocessed material image density)×100.

(4) Background Lightfastness

The heat-sensitive recording materials of Examples 1 to 10 and Comparative Examples 1 to 3 were exposed to direct sunlight of 500,000 lux·h (measured with a digital luminometer, T-1 available from Minolta Co., Ltd.), and their background density was measured with a Macbeth reflection densitometer, RD-918. The data are given in Table 1. The lower the value is, the better were the results.

(5) Chemical Resistance

Using a fluorescent ink pen (Zebra 2-Pink Fluorescent Pen from Zebra Corporation), the surface of each heat-sensitive recording material of Examples 1 to 10 and Comparative Examples 1 to 3 were written upon. After being left for 1 day, the materials were visually inspected to see whether or not background fogging occurred and whether image portions remained stable, and the materials evaluated according to the following criteria. The results are given in Table 1.

Criteria for Evaluation

A: No fogging, no changes in image portions.

B: Slight fogging, some color fading in image portions.

C: Remarkable fogging, color faded in image portions.

(6) Inkjet Printability

Using an inkjet printer (MJ930 manufactured by Seiko Epson Corp.), red letters were printed on each heat-sensitive recording material in a super-fine mode. The color (fogging) of the letters was evaluated. The results are given in Table 1.

Criteria for Evaluation

A: Printed letters were vivid red.

B: Printed letters were dark red.

C: Printed letters were closer to black than red.

TABLE 1

| | Sensitivity | Background Fogging | Image Preservability (%) | Background Lightfastness | Chemical Resistance | Inkjet Printability |
|---|---|---|---|---|---|---|
| Example 1 | 1.32 | 0.06 | 90 | 0.05 | A | A |
| Example 2 | 1.33 | 0.06 | 89 | 0.05 | A | A |
| Example 3 | 1.30 | 0.06 | 90 | 0.05 | A | A |
| Example 4 | 1.30 | 0.07 | 91 | 0.07 | A | A |
| Example 5 | 1.27 | 0.07 | 88 | 0.07 | A | A |
| Example 6 | 1.27 | 0.06 | 83 | 0.06 | A | A |
| Example 7 | 1.32 | 0.06 | 92 | 0.05 | A | A |
| Example 8 | 1.31 | 0.06 | 89 | 0.05 | A | A |
| Example 9 | 1.31 | 0.06 | 91 | 0.04 | A | A |
| Example 10 | 1.25 | 0.06 | 97 | 0.05 | A | A |
| Comp. Ex. 1 | 1.21 | 0.07 | 80 | 0.05 | C | C |
| Comp. Ex. 2 | 1.14 | 0.09 | 70 | 0.08 | A | C |
| Comp. Ex. 3 | 1.30 | 0.06 | 97 | 0.11 | A | A |

From Table 1, it is understood that the heat-sensitive recording materials of Examples 1 to 10 of the present invention were all highly sensitive and had good background fog resistance, color image storage stability, background lightfastness, chemical resistance and inkjet printability.

From Table 1, it is also understood that the heat-sensitive recording materials of Comparative Examples 1 to 3 were not good, and did meet the requirements of sensitivity, background fogging resistance, image preservability, background lightfastness and inkjet printability.

As described above, in accordance with the present invention, it is possible to provide, in comparison with conventional heat-sensitive recording materials, a heat-sensitive recording material that has high sensitivity, excellent preservability of image portions, background lightfastness, chemical resistance and inkjet printability, and in which background fogging does not occur to the extent that it poses practical problems.

What is claimed is:

1. A heat-sensitive recording material comprising a support having disposed thereon a heat-sensitive color-forming layer that includes an electron-donating leuco-dye, electron-receiving compound and UV absorbent, wherein the layer contains 4-hydroxybenzenesulfonanilide as the electron-receiving compound.

2. The heat-sensitive recording material according to claim 1, wherein the electron-donating leuco-dye comprises at least one selected from the group consisting of 2-anilino-3-methyl-6-di-n-butylaminofluoran, 2-anilino-3-methyl-6-di-n-amylaminofluoran, 2-anilino-3-methyl-6-(N-ethyl-N-p-benzyl)aminofluoran, 2-anilino-3-methyl-6-diethylaminofluoran, 2-anilino-3-methyl-6-(N-ethyl-N-isoamylamino)fluoran and 2-anilino-3-methyl-6-(N-ethyl-N-propylamino)fluoran.

3. The heat-sensitive recording material according to claim 1, wherein the UV absorbent comprises a benzotriazole UV absorbent.

4. The heat-sensitive recording material according to claim 1, wherein the amount of the UV absorbent is from 10 to 100 parts by mass relative to 100 parts by mass of the electron-receiving compound in the layer.

5. The heat-sensitive recording material according to claim 2, wherein the amount of the electron-donating leuco-dyes selected from the group is at least 50% by mass of all the electron-donating leuco-dyes comprised in the layer.

6. The heat-sensitive recording material according to claim 1, wherein the support has a surface smoothness of at least 300 seconds.

7. The heat-sensitive recording material according to claim 1, wherein the support comprises a base support and a undercoat layer disposed on the base support, wherein the base support has a Steckigt sizing degree of at least 5 seconds, and wherein the undercoat layer comprises pigment and binder.

8. The heat-sensitive recording material according to claim 7, wherein the dry weight of the undercoat layer is at least 2 g/m$^2$.

9. The heat-sensitive recording material comprising a support having disposed thereon a heat-sensitive color-forming layer that includes an electron-donating leuco-dye, electron-receiving compound and UV absorbent, wherein the layer contains 4-hydroxybenzenesulfonanilide as the electron-receiving compound, wherein the electron-donating leuco-dye comprises at least one selected from the group consisting of 2-anilino-3-methyl-6-di-n-butylaminofluorane, 2-anilino-3-methyl-6-di-n-amylaminofluoran and 2-anilino-3-methyl-6-(N-ethyl-N-p-benzyl)aminofluoran.

10. The heat-sensitive recording material according to claim 2, further including, as an additional electron-donating leuco-dye, at least one selected from the group consisting of 2-anilino-3-methyl-6-(N-ethyl-N-sec-butyl)aminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-di(n-butylamino)-7-(2-chloroanilino)fluoran, 3-diethylamino-7-(2-chloroanilino)fluoran, 3-diethylamino-6-methyl-7-anilinofluoran and 3-(N-cyclohexyl-N-methylamino)-6-methyl-7-anilinofluoran.

11. The heat-sensitive recording material according to claim 1, wherein the amount of the electron-donating leuco-dye is from 0.1 to 1.0 g/m$^2$.

12. The heat-sensitive recording material according to claim 1, wherein the amount of the electron-receiving compound is 50 to 400% by mass of the electron-donating leuco-dye in the layer.

13. The heat-sensitive recording material according to claim 1, wherein the amount of the electron-receiving compound is 100 to 300% by mass of the electron-donating leuco-dye in the layer.

14. The heat-sensitive recording material according to claim 1, further including, as an additional electron-receiving compound, at least one selected from the group consisting of phenolic compounds, salicylic acid derivatives and their polyvalent metal salts.

15. The heat-sensitive recording material according to claim 1, wherein the amount of 4-hydroxybenzenesulfonanilide is at least 50% by mass of all the electron-receiving compounds in the layer.

16. The heat-sensitive recording material according to claim 1, wherein the electron-receiving compound has a volume-average particle size of at most 1.0 $\mu$m.

17. The heat-sensitive recording material according to claim 1, wherein the UV absorbent is at least one selected from the group consisting of the following formulae:

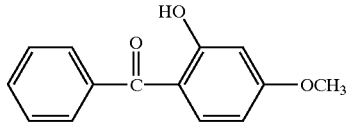

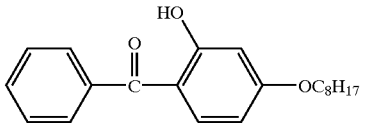

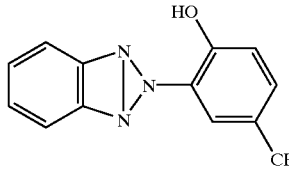

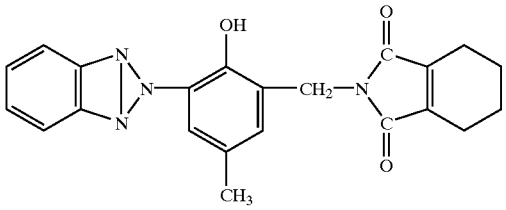

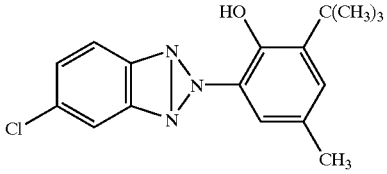

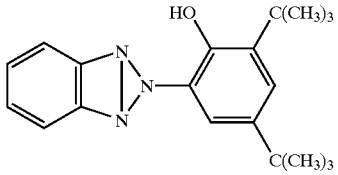

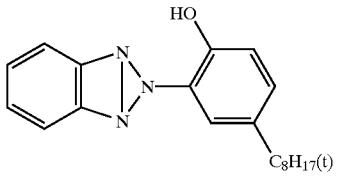

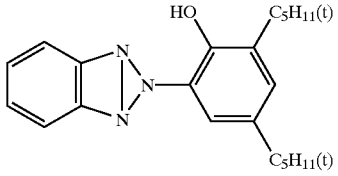

-continued

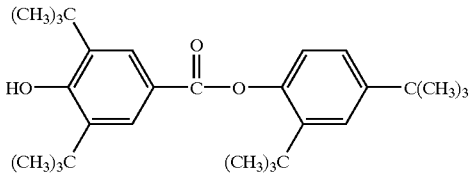

18. The heat-sensitive recording material according to claim 3, wherein the amount of the benzotriazole UV absorbent is 10 to 100 parts by mass relative to 100 parts by mass of the electron-receiving compound in the layer.

19. The heat-sensitive recording material according to claim 1, wherein the heat-sensitive color-forming layer contains at least one of an image stabilizer and a sensitizer.

20. The heat-sensitive recording material according to claim 1, further including a protective layer on the heat-sensitive color-forming layer.

* * * * *